US005826454A

United States Patent [19]

Kohnen

[11] Patent Number: 5,826,454

[45] Date of Patent: Oct. 27, 1998

[54] DEVICE FOR FLANGING THE END OF A METAL TUBE

[75] Inventor: Wolfgang Kohnen, Hanover, Germany

[73] Assignee: Alcatel Alsthom Compagnie Generale d'Electricite, France

[21] Appl. No.: 942,662

[22] Filed: Oct. 2, 1997

[30] Foreign Application Priority Data

Oct. 18, 1996 [DE] Germany ..... 296 18 108.0

[51] Int. Cl.[6] ..... B21D 19/04

[52] U.S. Cl. ..... 72/117; 72/123

[58] Field of Search ..... 72/115, 117, 120, 72/122, 123, 316, 124

[56] References Cited

U.S. PATENT DOCUMENTS

| | | | |
|---|---|---|---|
| 1,396,179 | 11/1921 | Foley | 72/123 |
| 2,840,136 | 6/1958 | Bellarts | 72/123 |

FOREIGN PATENT DOCUMENTS

| | | |
|---|---|---|
| 793 374 A | 1/1936 | France . |
| 67 50 388 | 1/1969 | Germany . |
| 77 467 C | 2/1984 | Germany . |
| 90 06 230 U | 8/1990 | Germany . |
| 90 06 230 U1 | 9/1990 | Germany . |

*Primary Examiner*—Lowell A. Larson
*Attorney, Agent, or Firm*—Ware, Fressola, Van der Sluys & Adolphson LLP

[57] ABSTRACT

A device is indicated for flanging the end of a metal tube to achieve a circumferential surface extending outward at right angles from the tube. It has the form of a cylindrical housing with a flange at its open end for fastening a clamping tool which is fastened to the tube, and its other end is closed by a bottom part. The housing has a flanging attachment that is able to rotate around the longitudinal axis of the housing, and a hand-wheel which is attached to a connecting element and extends outward through the bottom part. The hand-wheel is rigidly linked to a guide part of the flanging attachment by a threaded rod which fits through a suitably threaded bore in the bottom of the housing. A pressure element of the flanging attachment is guided by a pin which also forms part of the flanging attachment. The pressure element is operationally attached to the guide part so that it is able to rotate with it around the longitudinal axis of the housing. A lever mechanism is located between the guide part and the pressure element and comprises at least two levers that are linked to each other and also to the guide part and to the pressure element, whereby a movement of the guide part relative to the pin can be converted by the lever mechanism into movement of the pressure element in the radial direction of the housing.

5 Claims, 1 Drawing Sheet

DEVICE FOR FLANGING THE END OF A METAL TUBE

BACKGROUND OF THE INVENTION

1. Technical Field

The invention concerns a device for flanging the end of a metal tube to achieve a circumferential surface extending outward at right angles from the tube, comprising a flanging device which can be placed on the end of the tube and be attached thereto, where the device has the form of a cylindrical housing with a flange at the open end which is designed for fastening a clamping tool to the tube and is closed at the other end by a bottom part, wherein a flanging attachment with a pressure element is able to rotate around its axis, and the pressure element is adjustable along a straight line passing through the center of the tube at right angles to the axis thereof when the flanging device is attached, and where a hand-wheel is fastened to a connecting element protruding outward through the bottom part.

Such a device is used for hollow conductors to the end of which plugs or fittings or other continuing hollow conductors will be attached. The surface formed by the flanged edge is not only used to mechanically secure fastening elements, but also as an electric contact surface. However in principle such a surface can be used on all metal tubes whose ends must have a circumferential surface extending at right angles. It is unimportant whether the tube to be processed is smooth or corrugated in the transverse direction. Nor does the cross section of the tube, be it circular or elliptical, have any significance for the use of the device.

2. Description of the Prior Art

DE 67 50 388 describes a device for flanging the end of a tube including two clamping jaws that can be screwed to each other and in the installed position surround the tube to be processed. A pressure element for flanging the edge of the tube is attached to a bridge which can rotate around a ring fastened to the clamping jaws. To radially move the pressure element, a push rod tightener with a lever is attached to the bridge and can also be used to rotate the bridge. This known device can only be used if a lot of space is available around the tube end so that the relatively long, radially extending lever of the push rod tightener can be activated. It is furthermore difficult to adjust the device for the wall thickness of the tube to be processed.

In the device known from DE 90 06 230 U1, the radial dimensions are essentially determined by the dimensions of the cylindrical housing which like the clamping tool does not protrude significantly from the tube to be processed. After the clamping tool has been fastened, the entire device can be placed in the axial direction on the tube and secured to the clamping tool. The hand-wheel which protrudes in the axial direction is turned to produce the flanged edge, thereby also turning the pressure element which is adjusted stepwise with each rotation. This device does not require any space around the tube since the hand-wheel can easily be designed so that it does not protrude radially above the housing. This known device was proven in practice.

SUMMARY OF THE INVENTION

It is an object of the invention to further improve the prior devices described earlier and in particular to simplify them. This object is fulfilled according to the invention in that:

the hand-wheel is rigidly linked to a guide part of the flanging attachment by a threaded rod which fits through a suitably threaded bore in the bottom of the housing, the pressure element is guided by a pin located in the housing and is attached to the guide part so that it is able to rotate with it in a fixed plane around the housing axis, and is slidable along the pin in the radial direction, and a lever mechanism is located between the guide part and the pressure element and comprises at least two levers which are linked to each other and to the guide part as well as to the pressure element, whereby a movement of the guide part in the direction of the pin can be converted by the lever mechanism into movement of the pressure element in the radial direction of the housing.

This device has a particularly simple design. After assembly it forms a solid piece and is therefore simple to mount to the end of a tube. The combined effect of the threaded rod and the lever mechanism additionally achieves that the pressure element moves continuously outward when it is turned. This continuously flanges the edge of the tube without any steps. The result is an entirely uniform surface of the flanged edge which is particularly well suited for electrical contact.

The invention will be fully understood when reference is made to the following detailed description taken in conjunction with the accompanying drawing.

DETAILED DESCRIPTION OF THE INVENTION

Figure 2:
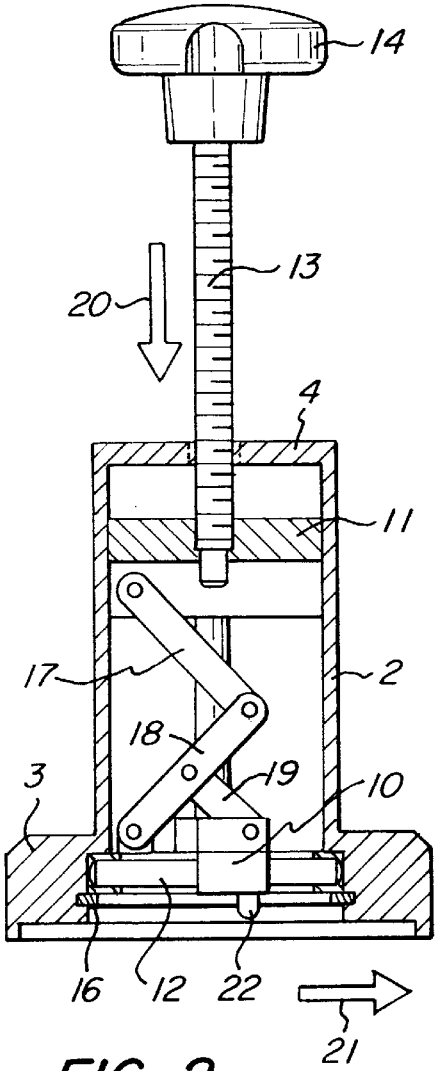
FIG. 2 is a cross-sectional view of the upper portion of the device in a different plane.
Figure 1:
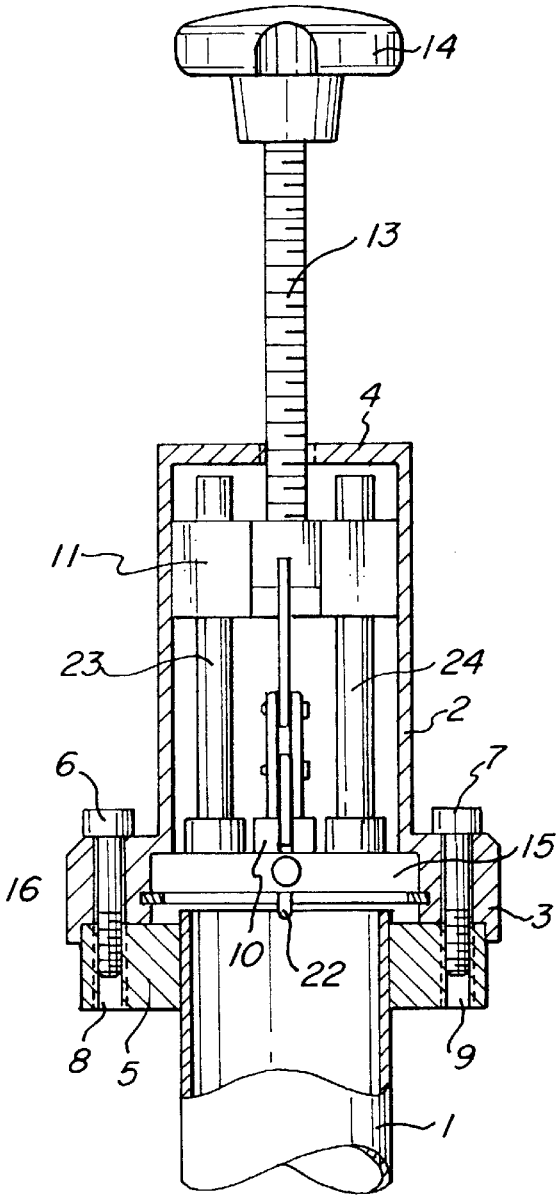
FIG. 1 is a cross-sectional view of the device of the invention installed on a tube.

FIGS. 1 and 2 illustrate the device of the invention hereinafter called "flanging device". FIG. 1 illustrates the working position of the flanging device. It can be installed on a tube 1 shown in FIG. 1 whose end is to be flanged. It has the form of a cylindrical housing 2 which has a flange 3 at its open end and is closed at the other end by a bottom part 4. As shown in FIG. 1, the flange 3 is used to secure a clamping tool 5 that is fastened to the tube 1. To that end, screws 6 and 7 can be used which enter into threaded holes 8 and 9 in the clamping tool 5. A pressure element 10 is arranged in the housing 2 and is used to flange the end of the tube 1.

The pressure element 10 is a portion of a flanging attachment which also comprises a guide part 11, a pin 12 and a lever mechanism. The guide part 11 is rigidly connected to a threaded rod 13 to which a hand-wheel 14 is attached. The threaded rod 13 threadingly extends through a threaded hole in the bottom part 4 of housing 2. The hand-wheel 14 is located in the axial extension of the flanging device. It is preferably designed so that it does not protrude radially beyond the proportions of housing 2. The pin 12 is imbedded in a rotating part 15 which enters into a circumferential expansion of the housing 2. The rotating part 15 is secured in the axial direction of the expansion by a retaining ring 16. In this way, the rotating part 15 and thus the pin 12 as well can only be turned around the axis of housing 2 in a fixed plane.

The lever mechanism, which in the illustrated embodiment comprises three levers 17, 18 and 19, is located between the guide part 11 and the pressure element 10. The levers 17, 18 and 19 are linked to each other and to the guide part 11, as well as to the rotating part 15 and the pressure element 10. Turning the hand-wheel 14 also turns the threaded rod 13. This also turns the flanging attachment which comprises the push pin 10, guide part 11, the rotating part 15 (with pin 12) and the lever mechanism around the axis of housing 2. The guide part 11, which is rigidly connected to the threaded rod 13, can move in the axial direction. Thus, when the hand-wheel 14 is turned, not only does it rotate the flanging attachment, it also moves the guide part 11 toward the pin 12 in the direction of arrow 20. This presses the levers 17 and 18 toward each other so that the angle between them becomes smaller. At the same time, lever 19 moves the pressure element 10 outward in the direction of arrow 21. When the hand-wheel 14 is turned in the opposite direction, the flanging attachment rotates in this opposite direction and the guide part 11 and the pressure element 10 move in the opposite directions of arrows 20 and 21.

Figure 3:
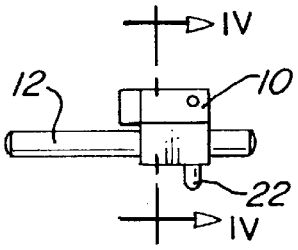
FIG. 3 is a side elevational view of the pin and pressure element.
Figure 4:
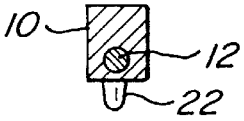
FIG. 4 is a cross-sectional view along line IV—IV of FIG. 3.

According to FIGS. 3 and 4, the pressure element 10 surrounds a large area of the pin 12 with little play. This ensures that it can be easily slid along the pin 12 without bending. Contact with the tube 1 takes place by means of the flanging pin 22 which is attached to the pressure element 10 and flanges the edge of the tube 1.

The lever mechanism comprising levers 17, 18 and 19 is designed so that no relative rotational movement between the guide part 11 and the rotating part 15 or pin 12 can take place. To exclude this entirely and unload the lever mechanism, at least one essentially rigid additional connecting element can be installed in the axial direction of the housing 2 between the guide part 11 and the rotating part 15. To that end, two rods 23 and 24 are provided as shown in FIG. 1, on which the guide part 11 can move in the axial direction.

The operation of the flanging device of the invention is as follows: First the clamping tool 5 is attached to the end of a tube 1 to be processed. The length of the tube end protruding from the clamping tool 5 can be accurately measured, for example by means of a gauge. The flanging device is then placed on the clamping tool 5 and the screws 6 and 7 are tightened so that the flanging device is secured to the clamping tool 5 and thereby to the tube 1. At that time, the pressure element 10 is in a position where it still makes no contact with the tube 1. After that, the hand-wheel 14 is turned and moves the pressure element 10 laterally in the direction of arrow 21 as the pressure element 10 simultaneously rotates around the housing axis with the guide part 11, lever mechanism (i.e., levers 17, 18, 19), rotating part 15, bolt 12 and rods 23, 24. Eventually, this causes the flanging pin 22 to engage the tube 1 to gradually bend and flange the tube wall until a circumferential surface is created at right angles to the axis of the tube 1.

The preferred embodiment described above admirably achieves the objects of the invention. However, it will be appreciated that departures can be made by those skilled in the art without departing from the spirit and scope of the invention which is limited only by the following claims.

What is claimed is:

1. A device for flanging the end of a metal tube to achieve a circumferential surface extending outward at right angles from the tube, comprising:

(a) a clamping tool adapted to be attached to the end of the tube;

(b) a cylindrical housing with an open end and a closed end, the closed end having a threaded bore, the cylindrical housing having a flange at the open end thereof for fastening the clamping tool;

(c) a flanging attachment located in the cylindrical housing and rotatable around a longitudinal axis of the housing, the flanging attachment having:

(i) a pin located in the housing and rotatable in a fixed plane around the longitudinal axis of the housing, (ii) a pressure element fastened for rotation with the pin around the longitudinal axis of the housing and slidable along the pin in a radial direction of the housing, (iii) a lever mechanism having at least two levers which are linked to each other, the lever mechanism linked at one end to the pressure element, and (iv) a guide part linked to the other end of the lever mechanism and adapted for movement relative to the pin, whereby movement of the guide part relative to the pin is converted by the lever mechanism into movement of the pressure element in the radial direction of the housing; and (d) a hand-wheel affixed by a threaded rod to the guide part of the flanging attachment for rotation therewith, the threaded rod threading engaged in the threaded bore in the closed end of the housing.

2. A device as claimed in claim 1, wherein the pressure element surrounds a large area of the pin.

3. A device as claimed in claim 2, wherein the flanging attachment further including at least one rigid connecting element provided between the guide part and the pin and extending in an axial direction of the housing.

4. A device as claimed in claim 1, wherein the flanging attachment further including at least one rigid connecting element provided between the guide part and the pin and extending in an axial direction of the housing.

5. A device as claimed in claim 1, wherein the flanging attachment further includes a rotating part located in a circumferential expansion of the housing and rotatable with the pin in the fixed plane.

* * * * *